US008424545B2

(12) United States Patent
Reboa

(10) Patent No.: US 8,424,545 B2
(45) Date of Patent: Apr. 23, 2013

(54) PORTABLE MODULAR WASHING UNIT FOR TURBOPROPS OF AIRCRAFT

(75) Inventor: Angelo Reboa, La Spezia (IT)

(73) Assignee: S.I.A. Società Idee Avioniche S.r.l., Florence (IT)

( * ) Notice: Subject to any disclaimer, the term of this patent is extended or adjusted under 35 U.S.C. 154(b) by 657 days.

(21) Appl. No.: 11/920,931

(22) PCT Filed: May 9, 2006

(86) PCT No.: PCT/IT2006/000330
§ 371 (c)(1),
(2), (4) Date: Apr. 6, 2009

(87) PCT Pub. No.: WO2006/123387

PCT Pub. Date: Nov. 23, 2006

(65) Prior Publication Data

US 2009/0199879 A1 Aug. 13, 2009

(30) Foreign Application Priority Data

May 19, 2005 (IT) ..... SP2005000004 U

(51) Int. Cl.
*B08B 3/04* (2006.01)

(52) U.S. Cl.
USPC ..... 134/102.2

(58) Field of Classification Search ..... 134/123, 134/198, 94.1, 102.2
See application file for complete search history.

(56) References Cited

U.S. PATENT DOCUMENTS 2,828,769 A * 4/1958 Cooper ..... 138/30
4,059,123 A * 11/1977 Bartos et al. ..... 134/102.2
4,655,123 A * 4/1987 Schrader ..... 99/279
4,862,551 A * 9/1989 Martinez et al. ..... 15/321
4,898,330 A * 2/1990 Betchan ..... 239/135
5,730,944 A * 3/1998 Peake ..... 422/111
6,394,148 B1 * 5/2002 Clarke ..... 141/2
6,484,907 B1 * 11/2002 Evans ..... 222/334
6,565,015 B2 * 5/2003 Leer et al. ..... 239/157
6,640,747 B2 * 11/2003 Reusche ..... 119/69.5
7,591,399 B2 * 9/2009 Hortin et al. ..... 222/144.5
7,661,393 B2 * 2/2010 Torgerson et al. ..... 119/669
7,905,428 B1 * 3/2011 Probasco ..... 239/305
2004/0050042 A1 * 3/2004 Frazer ..... 60/413

(Continued)

FOREIGN PATENT DOCUMENTS

DE 32 19 530 * 12/1983
DE 10351879 B3 4/2005
GB 1400198 7/1975
GB 2 148 397 * 5/1985

OTHER PUBLICATIONS

WIPO WO 92/14557 Sep. 1992.*

*Primary Examiner* — Michael Barr
*Assistant Examiner* — David Cormier
(74) *Attorney, Agent, or Firm* — Pollack, P.C.

(57) ABSTRACT

A washing unit for turboprops of aircraft is disclosed, which comprises a hydropneumatic accumulator suitable for supplying, at a controlled pressure, a washing fluid contained therein, and a filling member, motorized and manual, for feeding the washing fluid into the accumulator. The accumulator may be connected alternatively to the motorized filling member or to the manual filling member. A manually actuated device is also provided for pressurization of the accumulator, so that the washing unit can be used both in areas equipped for this operation and in areas not so equipped.

5 Claims, 5 Drawing Sheets

U.S. PATENT DOCUMENTS

2004/0140327 A1* 7/2004 Osborne et al. ..... 222/386.5
2005/0013652 A1 1/2005 Corbosiero ..... 401/289
2007/0034798 A1* 2/2007 Hamrelius et al. ..... 250/332
2008/0216640 A1* 9/2008 Brand et al. ..... 89/47

* cited by examiner

PORTABLE MODULAR WASHING UNIT FOR TURBOPROPS OF AIRCRAFT

FIELD OF THE INVENTION

This disclosure relates generally to cleaning units and, more particularly to portable units for washing components of aircraft or the like.

BACKGROUND OF THE INVENTION

A common problem experienced by helicopters and other turboprop type aircraft is the gradual accumulation of airborne saline residue and contaminants on surfaces of blades and rotors of their turboprops. This accumulation progressively impairs functional parameters and, thus, turboprop performance. Accordingly, it is important to remove such residue and contaminants so that blade and/or rotor surfaces are restored to their original condition, without jeopardizing aircraft efficiency. Although useful, conventional cleaning devices have often been found heavy, bulky and otherwise unsuitable for transport on aircraft such as a helicopter, or for operation in the field.

OBJECTS AND SUMMARY OF THE INVENTION

Accordingly, it is an object of the disclosure to provide a washing unit for turboprops of aircraft that is not only easy to transport and use for both desalinating washes and performance restoring washes, but also maximizes practicality, maneuverability and transportability during washing and performance restoration of aircraft turbines, whether during operation on a runway or in areas lacking an energy source.

Another object of the disclosure is to provide a washing unit for turboprops of aircraft that is both portable and modular.

A further object of the disclosure is to provide a washing unit for turboprops of aircraft having the advantages of modularity, compactness, lightness, simplicity and portability for air transport, thereby making the washing unit ideal for routine aircraft maintenance, both in areas devoted to aircraft maintenance and those outside such as in emergency zones.

According to one arrangement, a modular portable washing unit for turboprops of aircraft is provided. The unit comprises a hydropneumatic accumulator suitable for supplying washing fluid contained therein at a controlled flow rate and pressure, a motorized filling member and a manual filling member, for feeding the washing fluid into the accumulator, which may be connected alternatively to the motorized filling member or to the manual filling member, a manually actuated device also being provided for pressurization of the accumulator, such that the washing unit can be used both in areas equipped for this operation and in areas not so equipped. The hydropneumatic accumulator includes a tank divided into a first and second chamber by an elastic membrane, the washing fluid being contained in the first chamber. The first chamber is configured so as to be connected hydraulically to the motorized filling member or, alternatively, to the manual filling member, through a connector. The washing fluid is delivered to the first chamber from the connector via a filling conduit connected to a valve. A second conduit is connected between the valve and the first chamber, the second chamber containing a pressurization fluid, and being configured so as to be connected pneumatically.to a motorized pressurization member or to a manual pressurization member. Feeding washing fluid into the first chamber causes an increase in pressure of the pressurization fluid in the second chamber up to a predefined value, such that the washing fluid is supplied through the second conduit and valve to a delivery conduit to supply the washing fluid.

BRIEF DESCRIPTION OF THE DRAWINGS

A specific, illustrative portable modular washing unit for turboprops of aircraft, according to the disclosure, is described below with reference to the accompanying drawings, in which.

Figure 1:
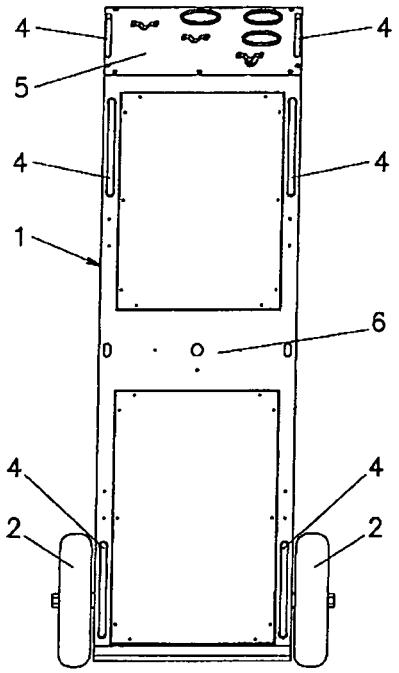
FIG. 1 is a front view of a washing unit, according to one aspect of the disclosure.
Figure 2:
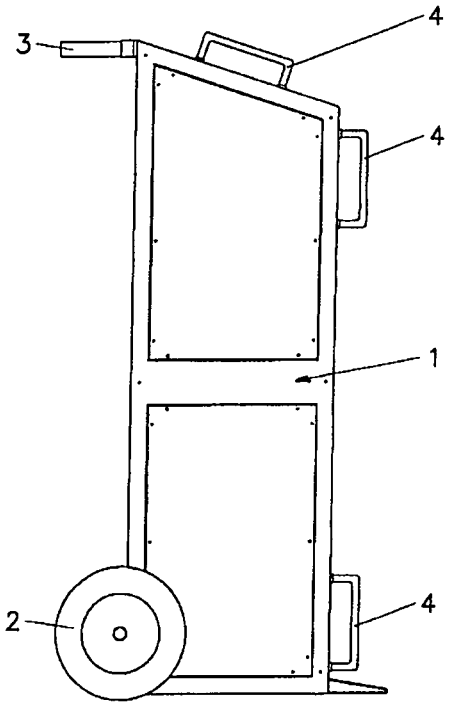
FIG. 2 is a side view of the unit shown in FIG. 1.
Figure 3:
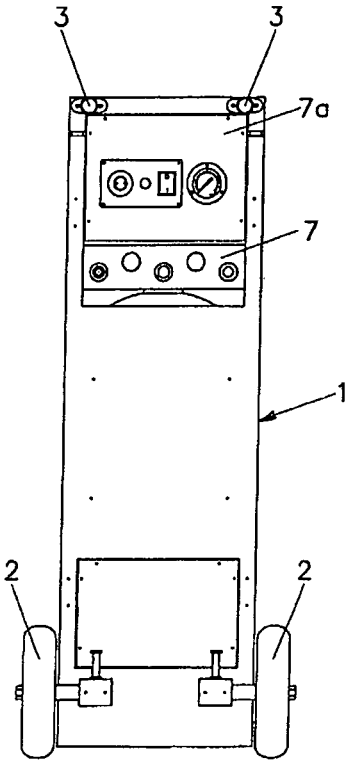
FIG. 3 is a rear view of the unit illustrated in FIG. 1.

Still other objects and advantages of the disclosure will become apparent from the following description of the preferred embodiments.

DETAILED DESCRIPTION OF THE PREFERRED EMBODIMENTS

Referring now to the drawings and, more particularly, to FIGS. 1-5, there is shown generally a specific, illustrative washing unit, according to various aspects of the disclosure. For example, as illustrated generally in FIG. 1, the unit comprises a frame 1 with an open welded and box-shaped profile, mounted on wheels 2 to ensure ready towability and having, on an upper side, a pair of tiltable hand-grips 3 for towing or pushing the unit and three pairs of handles 4 for raising the same. A pair of handles 4 extend from a control panel 5 located at the top of frame 1, while the other two pairs of handles 4 extend from sides of a front panel 6, on which there is provided a connection for a manual filling member. Hydraulic connections for service fluids are provided on a rear panel 7. Also on the rear, a panel 7*a* is provided upon which electrical connections to the aircraft are located as well as a pressure gauge 35 for displaying a pre-charge value of the accumulator.

Figure 5:
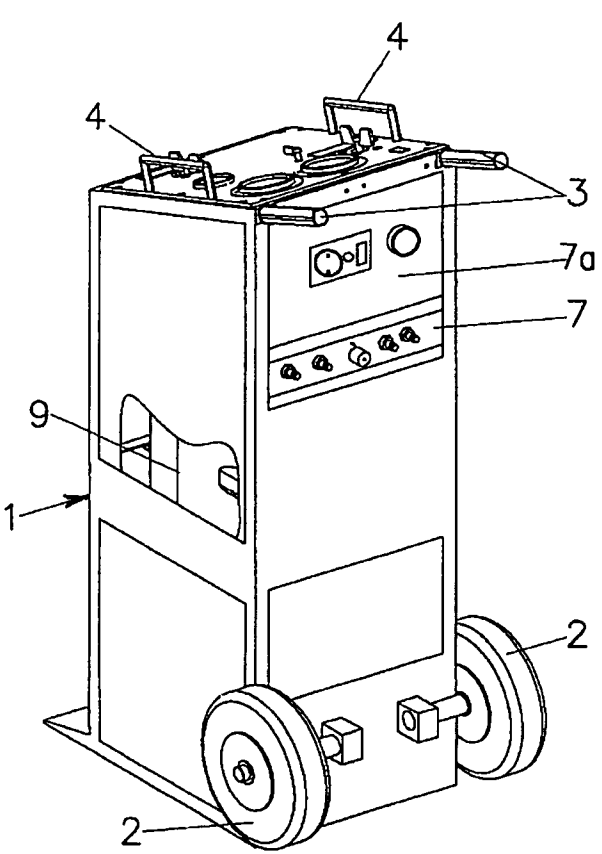
FIG. 5 is a rear perspective view of the unit shown in FIG. 1.
Figure 4:
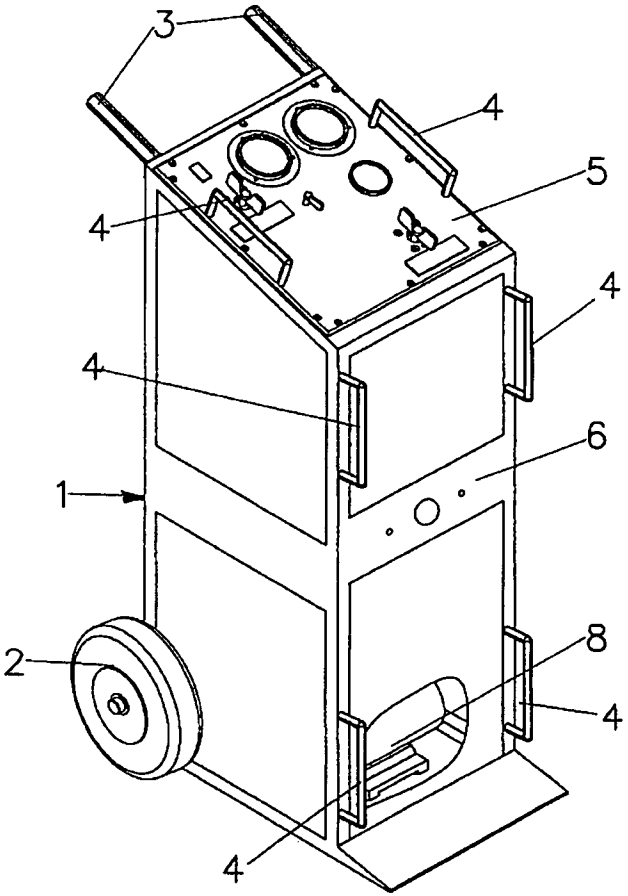
FIG. 4 is a front perspective view of the unit set forth in FIG. 1.

As shown in particular in FIGS. 4 and 5, an electric pump 8 is mounted on the base of frame 1 and a hydropneumatic accumulator 9 is positioned above the pump. The accumulator is preferably a tank, e.g., constructed of stainless steel, divided into two chambers, 9*a* and 9*b*, by a separation membrane 10, shown in the hydraulic diagram of FIG. 8. The chambers are intended to contain, respectively, a washing fluid and a pressurized fluid, in particular, compressed air. Feeding washing fluid into the chamber 9*a* causes an increase in pressure of the pressurized fluid in chamber 9*b* up to a predefined value. Pressure generated in this manner in accumulator 9 provides the energy necessary for supplying the washing fluid. Since the final filling pressure value is considerably higher than that of the pressure during use, a pressure regulator 11 is utilized at the output of chamber 9*a* (See FIGS. 7 and 8), on delivery line 12 of the accumulator, to reduce the pressure of the washing mixture to a value established by the turboprop manufacturer, thereby allowing controlled outflow of the mixture. Delivery conduit 12 is connected to the accumulator via a three-way valve 13 and a pipe 14.

Electric pump 8 draws washing fluid from a tank 15 and is connected to the three-way valve 13 via filling conduits 16 and 36. Alternatively, chamber 9*b* may be connected via a hose 17 to a pressurization device, for example, a battery powered, compressed air gun or a pedal pump.

The washing unit or module also has two connectors 18, respectively, one on filling conduit 36 and the other on hose 17, for hydraulic connection to a portable filling apparatus for the washing and pressurized fluid that can be used when washing operations must be performed in the field, such as in areas where suitable equipment or electrical energy are not available. More particularly, the portable apparatus includes a manual pump 21 and a pneumatic pedal pump 20 for feeding the pressurized fluid into chamber 9*b* of the accumulator. Alternatively, as shown, for instance, in FIG. 4, manual pump 21 may be replaced by electric pump 8, which can be connected to a service intake of the aircraft. Other useful accessories include a flexible tube 23 used to deliver the washing fluid, and a set of implements for attachment and depressurization 24. These accessories are conveniently stored in a special bag 22.

Figure 7:
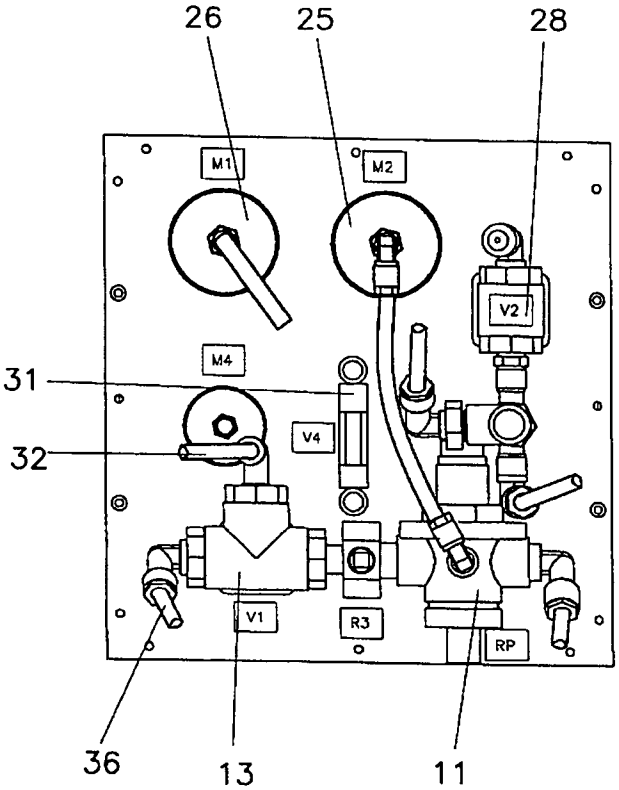
FIG. 7 is a plan view from an inside portion of the control panel of FIG. 6, specularly reversed in relation to the latter.
Figure 6:
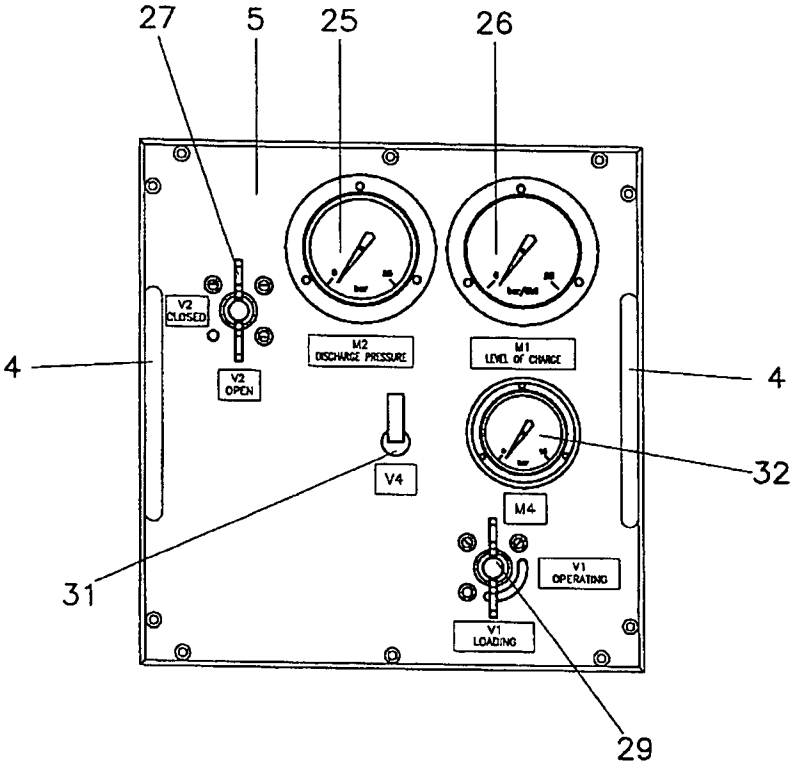
FIG. 6 is a plan view of a control panel of the unit illustrated in FIG. 1.
Figure 8:
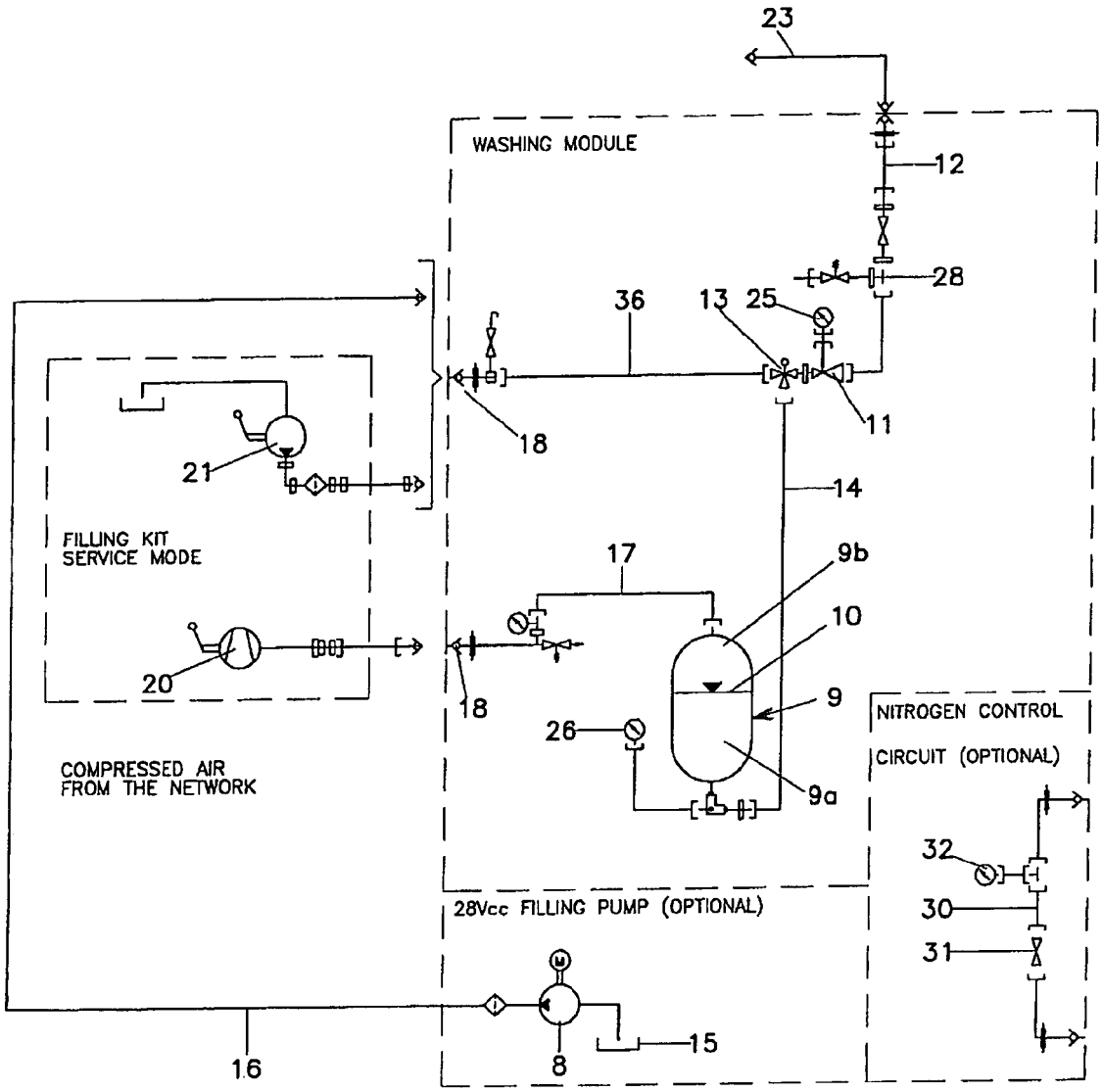
FIG. 8 illustrates schematically a hydraulic circuit of the unit shown in FIG. 1.
Figure 10:
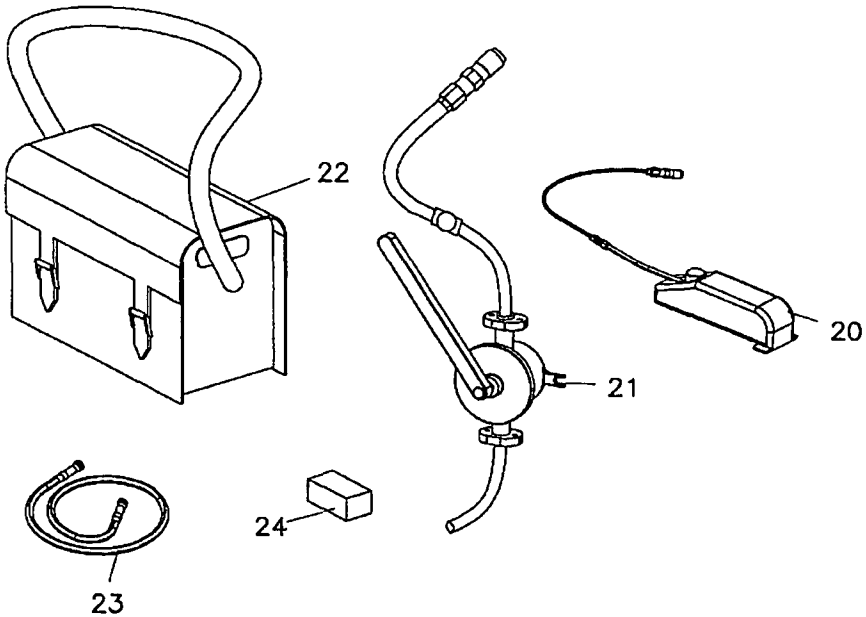
FIG. 10 shows a set of accessories associated with the unit illustrated in FIG. 1 that may be adapted for use in non-equipped areas.

As illustrated in FIGS. 6 and 7, positioned on control panel 5 are a first pressure gauge 25 for controlling the delivery pressure, a second pressure gauge 26 for controlling the level of fluid available inside the accumulator, a first key 27 for opening and closing of a delivery valve 28 located on delivery conduit 12, and a second key 29 for setting three-way valve 13 and adjusting the same from a working position to a filling position and vice versa. Desirably, the valves are positioned immediately below the control panel, as shown in FIG. 7, where valve 11 for regulating the supply pressure of the washing fluid is also shown.

The washing unit, according to this disclosure, also provides the capability of blowing nitrogen during washes performed on selected turboprops (for example, a Lycoming turboprop installed on a Piaggio P166 DL3 aircraft). To this end, a bypass 30 is provided suitably with relative fast couplings mounted on panel 7 for connection to a feed hose (not shown) from the gas cylinder and a supply hose (not shown), as well as a feed valve 31 and a control pressure gauge 32 positioned, respectively, below and above the control panel.

Although the washing unit has been shown and described in connection with washing components of aircraft such as the Lycoming LTP 101-700 installed on the Piaggio P166 DL 3SEM aircraft, and Pratt & Whitney PT6T Series T3-T6 turboprops installed on a helicopter AB 412, those skilled in the art will appreciate its application to other components and aircraft, given consideration to the purpose for which the unit is intended.

The washing unit, according to the disclosure, advantageously permits both desalinated washing of a turboprop using distilled water, and washing for performance recovery which, as is known, may be accomplished in two steps. During the first step, a mixture of distilled water and detergent is used, while in the second step, the turboprop is double rinsed with distilled water.

Using the accessories supplied, the washing unit may be readilyy transported on an aircraft, for example, in a tail boom section of a helicopter, in a completely empty and depressurized state attached to the aircraft, as appropriate, at various anchorage points formed on frame 1, for deployment, e.g., in areas not equipped for operation.

Figure 9:
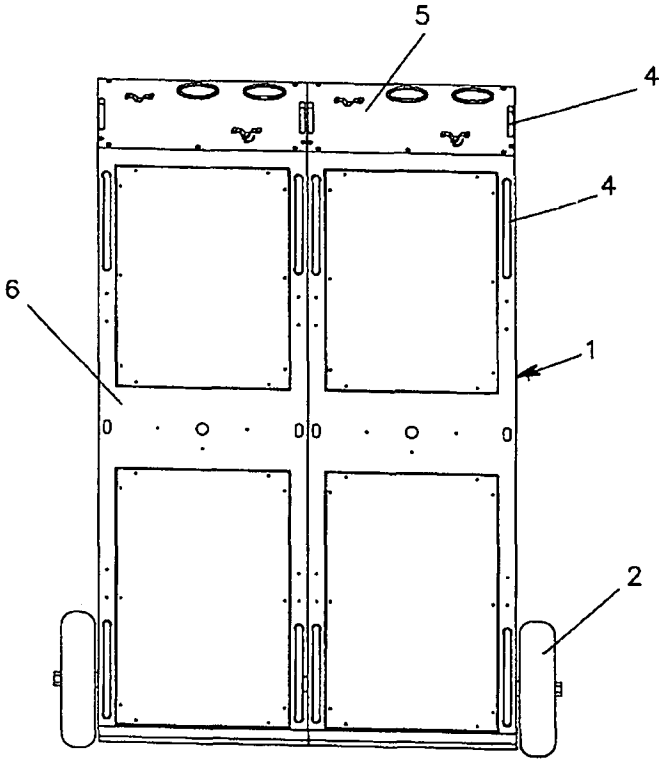
FIG. 9 is a front view of two washing units, according to another aspect of the disclosure, connected modularly one to the other.

Moreover, because the unit is completely modular, two washing unit modules, according to the disclosure, may be joined together, in a side-by-side fashion, as shown in FIG. 9, for use in a hangar. In such case, washing may be done, for instance, to restore turboprop performance where a mixture of detergent and distilled water for subsequent rinsing must be used.

Various modifications and alterations may be appreciated based on a review of this disclosure. These changes and additions are intended to be within the scope and spirit of the disclosure as defined by the following claims.

What is claimed is:

1. A washing unit for turboprops of aircraft, the unit comprising a hydropneumatic accumulator suitable for supplying washing fluid contained therein at a controlled flow rate and pressure, a motorized filling member and a manual filling member, for feeding the washing fluid into the accumulator, which may be connected alternatively to the motorized filling member or to the manual filling member, a manually actuated device also being provided for pressurization of the accumulator, such that the washing unit can be used both in areas equipped for this operation and in areas not so equipped, wherein the hydropneumatic accumulator includes a tank divided into a first and second chamber by an elastic membrane, the washing fluid being contained in the first chamber, the first chamber being configured so as to be connected hydraulically to the motorized filling member or, alternatively, to the manual filling member, through a connector, the washing fluid being delivered to the first chamber from the connector via a filling conduit connected to a valve and a second conduit connected between the valve and the first chamber, the second chamber containing a pressurization fluid, the second chamber being configured so as to be connected pneumatically to a motorized pressurization member or to a manual pressurization member, whereupon feeding of washing fluid into the first chamber causes an increase in pressure of the pressurization fluid in the second chamber up to a predefined value, such that the washing fluid is supplied through the second conduit and valve to a delivery conduit to supply the washing fluid.

2. The washing unit set forth in claim 1, further comprising a transportable box-shaped frame wherein the hydropneumatic accumulator and the motorized filling member are placed.

3. The washing unit forth in claim 1, wherein the manual filling member comprises a manual pump.

4. The washing unit set forth in claim 1, wherein the manually actuated pressurization device comprises a pneumatic pedal pump.

5. The washing unit set forth in claim 1, further comprising a kit of accessories for carrying out washing in areas not equipped for operation, which kit includes a manual pump, a pneumatic pedal pump and an accessory for depressurization.

* * * * *

UNITED STATES PATENT AND TRADEMARK OFFICE

CERTIFICATE OF CORRECTION

PATENT NO. : 8,424,545 B2
APPLICATION NO. : 11/920931
DATED : April 23, 2013
INVENTOR(S) : Angelo Reboa It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1320 days.

Signed and Sealed this
Eighth Day of September, 2015

Michelle K. Lee

Michelle K. Lee
*Director of the United States Patent and Trademark Office*